US008813304B2

(12) United States Patent
Young

(10) Patent No.: US 8,813,304 B2
(45) Date of Patent: Aug. 26, 2014

(54) COMBINATION OF A MOP HEAD AND WRINGING DEVICE

(75) Inventor: Ronald Alexander (Scot) Young, Stourbridge (GB)

(73) Assignee: Ronald Alexander Young, Stourbridge (GB)

( * ) Notice: Subject to any disclaimer, the term of this patent is extended or adjusted under 35 U.S.C. 154(b) by 0 days.

(21) Appl. No.: 13/518,805

(22) PCT Filed: Jan. 17, 2011

(86) PCT No.: PCT/GB2011/050063

§ 371 (c)(1),
(2), (4) Date: Jun. 22, 2012

(87) PCT Pub. No.: WO2011/089415

PCT Pub. Date: Jul. 28, 2011

(65) Prior Publication Data

US 2013/0047360 A1 Feb. 28, 2013

(30) Foreign Application Priority Data

Jan. 22, 2010 (GB) ..... 1001035.3

(51) Int. Cl.
*A47L 13/59* (2006.01)
*A47L 13/24* (2006.01)
*A47L 13/20* (2006.01)

(52) U.S. Cl.
USPC ..... 15/261; 15/229.2

(58) Field of Classification Search
USPC ..... 15/119.1, 147.1
See application file for complete search history.

(56) References Cited

U.S. PATENT DOCUMENTS 2,064,015 A * 12/1936 Kootz ..... 403/24
4,541,139 A * 9/1985 Jones et al. ..... 15/171

(Continued)

FOREIGN PATENT DOCUMENTS

| | | | |
|---|---|---|---|
| DE | 202009011590 | U1 | 1/2010 |
| FR | 814316 | A | 6/1937 |
| GB | 2214417 | A | 9/1989 |
| GB | 2417194 | A | 2/2006 |

OTHER PUBLICATIONS

International Search Report in corresponding PCT/GB2011/050063 dated Jul. 22, 2011.

(Continued)

*Primary Examiner* — Monica Carter
*Assistant Examiner* — Stephanie Berry
(74) *Attorney, Agent, or Firm* — Marshall, Gerstein & Borun LLP

(57) ABSTRACT

A mop head and a wringer device combination is described in which the mop head includes a body and a holder, the mop head body supporting mop material, and the holder mounting the mop head to a handle, the mop head holder having a first part secured to or integral with the body, a second part which inter-engages, in use with the handle, and a connecting portion connecting the first and second holder parts, and wherein the wringer device includes a wringing chamber, a pair of pressure bars, and an actuating mechanism relatively to move the pressure bars between an open condition in which the mop head body is receivable between the pressure bars into the wringing chamber, and a closed condition in which the pressure bars are alongside one another and are spaced from one another by a space, and the pressure bars act on a bearing surface or surfaces of the mop head to urge the mop head body towards a bottom wall of the wringing chamber to wring the mop material, with the connecting portion of the holder extending along the space between the pressure bars, the connecting portion having a thickness less than a separation distance or minimum separation distance between the pressure bars.

16 Claims, 3 Drawing Sheets

(56) References Cited

U.S. PATENT DOCUMENTS

| | | | | |
|---|---|---|---|---|
| 5,584,091 | A * | 12/1996 | Borofsky | 15/115 |
| 6,055,698 | A | 5/2000 | De Guzman | |
| 2003/0056315 | A1 * | 3/2003 | Salmon | 15/261 |
| 2006/0032011 | A1 * | 2/2006 | Young | 15/261 |
| 2010/0162507 | A1 | 7/2010 | Lee | |

OTHER PUBLICATIONS

Search Report from Intellectual Property Office of the United Kingdom in corresponding application No. GB1001035.3 dated May 18, 2010.

* cited by examiner

COMBINATION OF A MOP HEAD AND WRINGING DEVICE

DESCRIPTION OF INVENTION

This invention relates to a combination of a mop head and a wringer device.

Wringer devices for wringing mop material of mop heads are well known. In a typical kind of wringer device, a pair of pressure bars are provided which are moveable by an actuating mechanism from an open condition in which mop material supported by the mop head of a mop head is receivable in a wringing chamber of the wringer device, and a closed condition in which the pressure bars act on the mop material, to urge the mop material towards a bottom of the wringing chamber to effect wringing of the mop material.

When the pressure bars are in their closed condition, the pressure bars extend alongside one another and are spaced apart by a wide separation distance so that the pressure bars can act on the mop material of a wide variety of sizes and shapes of mop heads, typically so-called wet-mop mop heads in which a mop head body supports mop material, such as strands of woven or non-woven material, which is wetted for use in cleaning a floor.

Because the separation distance of the closed pressure bars has been wide to accommodate a wide variety of different kinds of such wet-mop mop heads, such wringer devices cannot effectively be used to wring out mop material of a so-called flat-mop. This is because a flat-mop tends to have a thin flat mop head which includes two parts which are foldable from a flat condition in which a sheet of mop material lies alongside the flat mop head parts, and a relatively folded condition in which the sheet of mop material depends as a loop from the relatively folded flat mop head parts.

Although the depending loop of sheet mop material can be received between the open pressure bars of known wet-mop wringer devices, when the pressure bars are closed, because of their wide separation distance, the pressure bars do not act on sufficient of the mop material effectively to wring the sheet mop material. As flat-mops tend to be used for drying floors, they do require be able to be wrung out to a great extent so that the sheet mop material is substantially dried by the wringing process. Accordingly it has been proposed to wring out so called flat-mops of this kind in especially designed wringer devices e.g. in which the separation distance between the two pressure bars is narrow.

However hithertofore wringer devices with narrowly spaced pressure bars have not been useable to wring out mop material of so called wet-mops as the mass of the mop material is too great for the narrow separation distance between the pressure bars.

Therefore it has been necessary to provide wringer devices for wet-mops and differently configured wringer mechanisms for flat mops.

According to a first aspect of the invention I provide In combination, a mop head and a wringer device, the mop head including a body and a holder, the mop head body supporting mop material, and the mop head holder in use, mounting the mop head to a handle, the mop head holder having a first part secured to or integral with the body, a second part which interengages, in use with the handle, to mount the handle to the mop head, and a connecting portion connecting the first and second holder parts, and wherein the wringer device includes a wringing chamber, a pair of pressure bars, and an actuating mechanism relatively to move the pressure bars between an open condition in which the pressure bars are apart and the mop head body is receivable between the pressure bars into the chamber, and a closed condition in which the pressure bars are alongside one another and are spaced from one another by a space, and the pressure bars act on a bearing surface or surfaces of the mop head to urge the mop head body towards a bottom of the wringing chamber to wring the mop material, and wherein when the pressure bars are in their closed condition acting on the bearing surface or surfaces of the mop head, the connecting portion of the holder extends along the space between the two pressure bars, the connecting portion having a thickness less than a separation distance or minimum separation distance between the pair of pressure bars.

By virtue of the invention, the mop material of a wet-mop can be wrung out in the wringer device in which the pressure bars may only be narrowly separated when closed, because the pressure bars will act on the bearing surface or surfaces of the mop head, and the thin connection portion of the holder can extend between the closed pressure bars. Moreover the same wringer device can be used to wring out flat-mops so that a common wringer device can be used for wringing both wet-mops and flat-mops.

In a preferred embodiment of the invention, the mop head body and the holder and the bearing surface or surfaces are provided as a single fabrication to ensure that the connecting portion of the holder has the appropriate strength in use of the mop head in mopping. For example the mop head body and the holder may be fabricated in metal or moulded in a plastic material, in each case to provide the connection portion with sufficient strength.

The mop head body may co-operate with a separate support member which together with the mop head body, supports the mop material. Also the holder may co-operate with one or more other components to provide the mounting for the handle.

Depending upon the mop head design, the bearing surface or surfaces on which the pressure bars act, may be integrally provided with the body, or attached to the body, or may be integral or attached to the holder.

In each case though the wringing chamber needs to be sized to accommodate wet mop mop material of large wet mops, and may be adapted i.e. the size of the wringing chamber may be reduced by the insertion of an adaptor, to accommodate smaller wet mop mop material, or the mop material of a flat mop. For example the effective depth of the wringing chamber may be reduced by placing an adaptor in the form of a rigid, semi-rigid or resilient plate-like member, in the wringing chamber e.g. on the chamber bottom to reduce the height of the wringing chamber.

The wringer device may provide a storage location for such an adaptor when the adaptor is not in use. For example, on an exterior surface of the wringing chamber, a support formation may be provided to support the adaptor when not in use.

In one example, the first part of the holder may include a socket to interengage with the handle, and desirably the thickness of the connecting portion of the holder is less than the corresponding dimension of the socket.

The connecting portion needs to be sufficiently long so as to enable the pressure bars to close without fouling the second holder part. For example, the connecting portion may have a length at least as long as the second part of the holder, and preferably at least 1.5 times the length of the second holder part. In another example, the connecting portion may be at least 15 mm long. Preferably the connecting portion is at least 25 mm long. More preferably the connecting portion is at least 35 mm long. Yet more preferably the connecting portion is at least 40 mm long.

According to a second aspect of the invention we provide a mop head holder for mounting a mop head to a handle, the mop head holder having a first part secured to or integral with the body, a second part which interengages, in use with the handle to mount the handle to the mop head, and a connecting portion connecting the first and second holder parts, the connecting portion having a thickness less than that of a corresponding dimension of the first part of the holder.

The mop head holder of the second aspect of the invention may have any of the features of the mop head holder used in the method of the first aspect of the invention.

Embodiments of the invention will now be described with reference to and/or as shown in the accompanying drawings in which.

Figure 1:
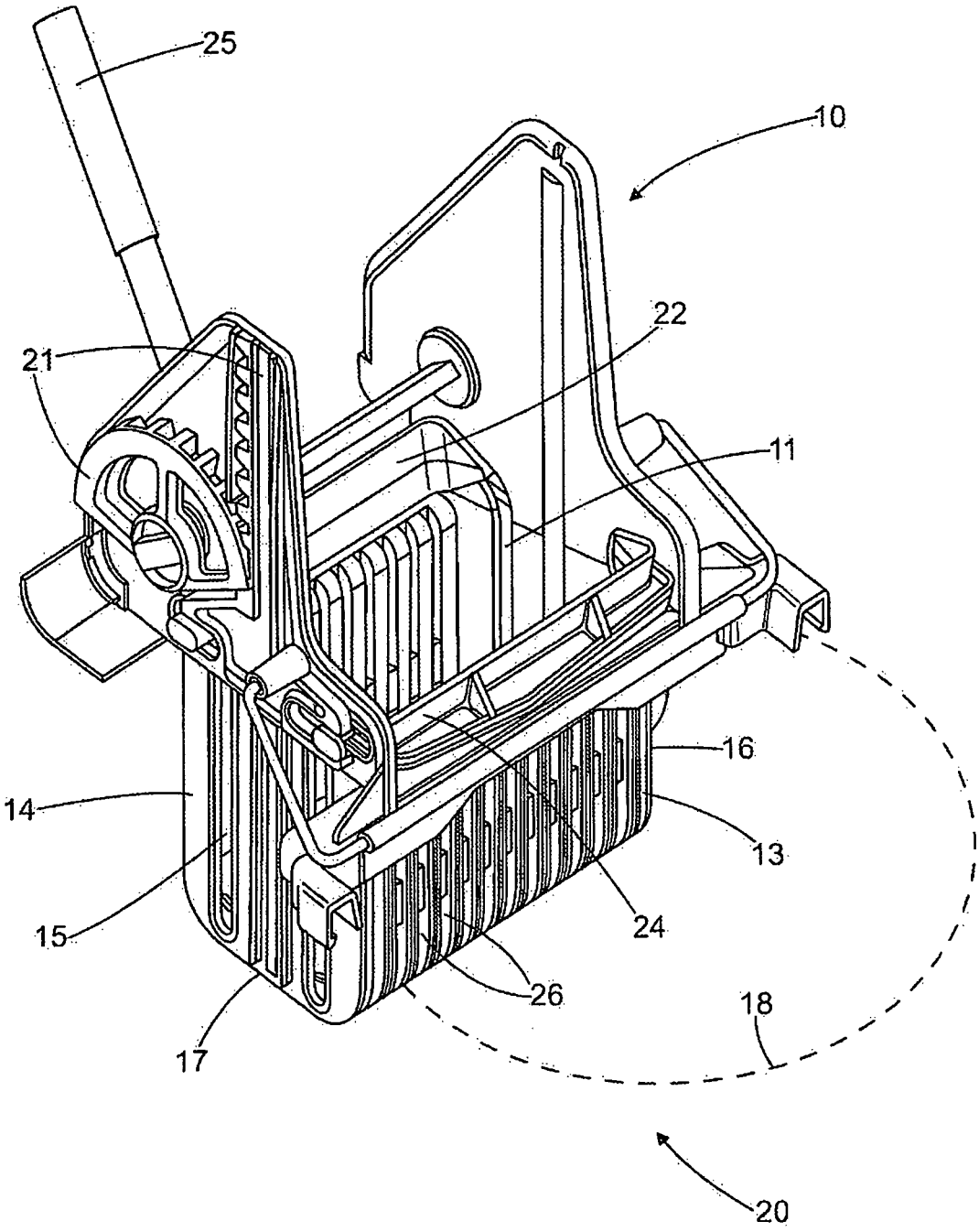
FIG. 1 is an illustrative perspective view of a wringer device for use in the combination of the invention with pressure bars in an open condition.

Referring to FIGS. 1 to 4 a wringer device 10 includes a wringing chamber 11 which in this exemplary embodiment is provided by a basket with a pair of opposite sides 13, 14, a pair of opposite ends 15, 16, and a chamber bottom wall 17. The wringing chamber 11 thus provides a volume into which mop material can be introduced for wringing out.

The wringer device 10 typically is adapted to be mounted on the rim 18 of a bucket 20 (only an outline is shown), and/or partially within the bucket 20 as is well known in the art.

Figure 2:
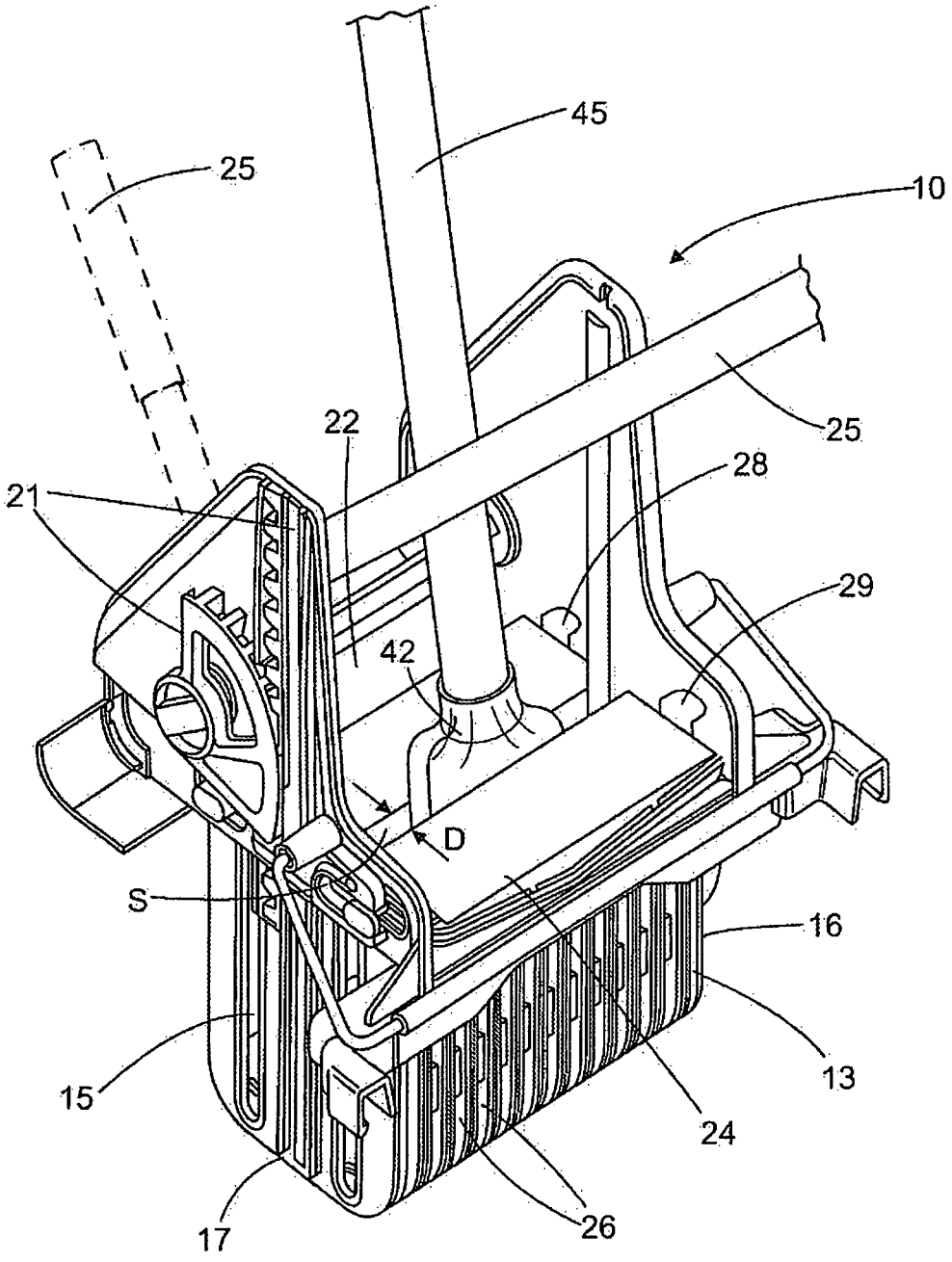
FIG. 2 is a view similar to FIG. 1 but showing the pressure bars in a closed condition wringing the mop material of a wet mop.

The wringing device 10 provides in the wringing chamber 11, a pair of pressure bars 22, 24 which are moveable in the chamber 11 between the open condition shown in FIG. 1 and the closed condition shown in FIG. 2, along guides 28, 29 provided in the end walls 15, 16 of the wringer device 10. Such movement is effected by means of an actuating mechanism typically including gears 19 and/or levers which are accommodated within end walls 15, 16 of the wringer device 10, and an actuating lever 25 which is manually operable. The lever 25 is manually pulled forwards by an operator from the position shown in FIG. 1, to move the pressure bars 22, 24 to the closed condition, and to exact a wringing force on mop material in the chamber 11 as hereinafter described.

Typically one or each of the sides 13, 14, and/or ends 15, 16 and/or chamber bottom wall 17 has an opening 26, or preferably openings to facilitate water drainage during wringing.

A mop head 30 includes a body 31 which may for example provide an underside recess 32, to receive and support mop material 33, such as the plurality of strands of woven or non-woven material shown in the drawings. The body 31 may co-operate with a support member such as a clip 34 to support and hold the mop material 33 which thus may be replaced when required, or the mop material 33 may be bonded or otherwise permanently supported in the recess 32.

The mop head 30 further includes a mop head holder 40 which has a first part 41 which in this example is integral with the mop head body 30, but could be separate and attached to the body 31 as required, and a second part 42 which in this example provides a female threaded socket 43 to receive a male threaded boss 44 of a mop handle 45. The boss 44 may be integral with a shaft 46 of the handle 45 or otherwise a threaded component attached to (e.g. in an opening in) the shaft 46 of the mop handle 45. In the generality the second holder part 42 interengages with the handle 45, possibly co-operating with one or more other components, such as a shroud 47 which covers the connection between the holder socket 43 and the boss 44, to mount the mop head 30 on the handle 45.

Between the first and second holder parts 41, 42 there is a connecting portion 48.

In the example, the first and second holder parts 41, 42 and the connecting portion 48 are integrally provided. Thus in the example the mop head body 31 and the holder 40 are integral being provided as a single metal fabrication, or plastic moulded component.

Figure 4:
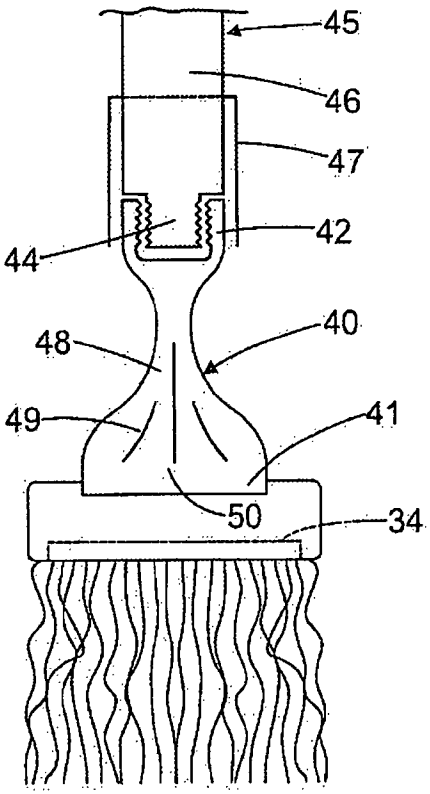
FIG. 4 is an illustrative side view of the mop head of FIG. 3.
Figure 3:
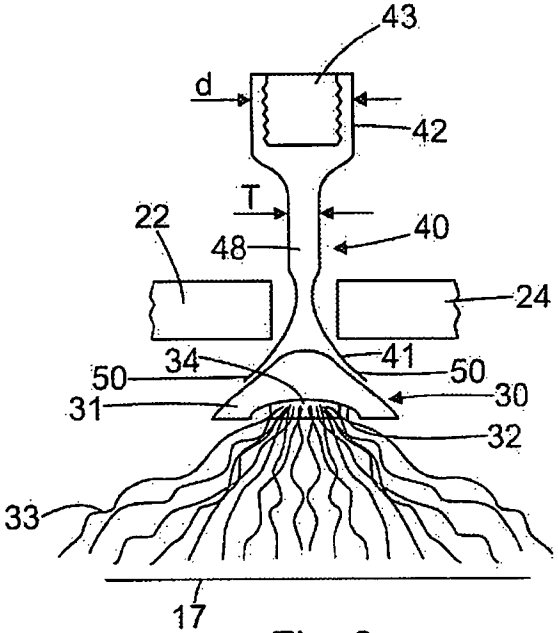
FIG. 3 is an illustrative end view of a the wet-mop mop head shown being wrung out.

It can be seen from FIGS. 3 and 4 especially that the connecting portion 48 is thin along the length of the mop head 30, having a maximum thickness T. The material from which the connecting portion 48 is in the example made, is strengthened with ribbing 49 so that the thin connection portion 48 section can withstand the forces experienced when the mop is in use cleaning a floor.

When it is desired to wring out the mop material 33 of the mop head 30, the mop head 30 is placed in the wringing chamber 11, or at least the body 31 of the mop head 30 and the mop material 33 and the first part 41 of the holder 40 are placed in the wringing chamber 11, with the pressure bars 22, 24 in the open condition shown in FIG. 1.

The actuating mechanism is then operated by a user pulling on the handle 25, to close the pressure bars 22, 24 on top of the mop head body 31, as illustrated in FIG. 3, to exert a downwards force on the body 31, thus to squeeze and wring out the mop material 33, between the body 31 and the bottom wall 17 of the wringing chamber 11.

In FIG. 3 it can be seen that the pressure bars 22, 24 bear down on respective bearing surfaces 50 of the mop head 30, which in this example are provided by the first holder part 41. The first holder part 41 flares from the thin connecting portion 48 of the holder 40, to where the first holder part 41 joins the body 31 of the mop head 30, to provide the bearing surfaces 50.

The length of the connecting portion 48 needs to be sufficiently long so that the second holder part does not foul the pressure bars 22, 24 as they close. For example, the connecting portion 48 length may be at least as long as that of the second holder part 42, and desirably, at least 1.5 times the length of the second holder part 42.

By another measure, the connecting portion may be at least 15 mm long. Preferably the connecting portion is at least 25 mm long. More preferably the connecting portion is at least 35 mm long. Yet more preferably the connecting portion is at least 40 mm long.

In another example, one or more bearing surfaces 50 on which the pressure bars 22, 24 bear down when the pressure bars 22, 24 are closed, could be provided otherwise by the mop head 30, for example integrally or attached to the body 31.

In each case a wringing force generated by pulling the handle 25 of the actuating mechanism, is transmitted through the bearing surface or surfaces 50, to the body 31 and hence to the mop material 33.

When the pressure bars 22, 24 are closed, the pressure bars 22, 24 will lie alongside one another with a space S between them As can be seen from FIG. 2, the thickness of the connecting portion 48 is thinner than the separation distance D between the pressure bars 22, 24, so that the pressure bars 22, 24 can be closed about the connecting portion 48 which will extend lengthwise along the space S between the closed pressure bars 22, 24, with part of the connecting portion 48 beneath the pressure bars 22, 24, and part of the connecting portion 48 and the second holder part 42, above the pressure bars 22, 24.

It can also be seen that the dimension of the first holder part 42 which corresponds to the separation distance of the space S between the pressure bars 22, 24, i.e. the outside diameter d of the socket 43, is greater than both the thickness T of the connecting portion 48, and the separation distance D between the pressure bars 22, 24.

The combination of the invention contrasts with prior proposals for wringer devices 10 in which mop material only is received beneath the pressure bars, which are more widely spaced than in the case of the wringer device 10 for the combination of the invention, when in their closed condition, in order that the wringer device can accommodate a variety of different kinds of wet mop.

Moreover, by virtue of the narrow separation distance D of the space S between the pressure bars 22, 24, the wringer device 10 can be used to wring out so called, flat mops of the kind which have a pair of generally flat body parts which are foldable from an in use flat condition in which a sheet of mop material lies alongside the flat mop parts for use, to a folded condition in which the sheet of mop material depends as a loop from the relatively folded flat body parts. The loop of sheet mop material can be received in the wringing chamber 11, and the pressure bars 22, 24 closed onto at least a major portion, if not all of the mop material, with the entire flat mop body above the closed pressure bars 22, 24, to effect wringing.

Figure 5:
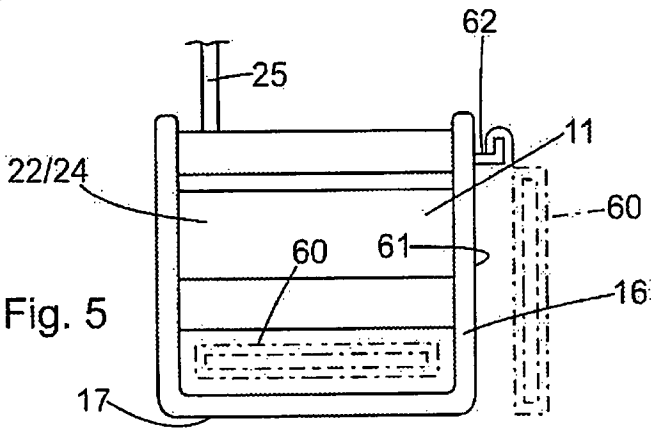
FIG. 5 is an illustrative side sectional view though a modified wringer device.

As desired, where the wringer device 10 is used for wringing mop material of smaller mops (i.e. mops with less mop material and usually a smaller mop head body 31) than the maximum size which can be accommodated by the wringing chamber 11, the wringing chamber 11 may be adapted as suggested in FIG. 5. A generally flat rigid, semi-rigid or resilient plate like adaptor 60 may be placed in the wringing chamber 11 to reduce its volume for more effective wringing. In the example the adaptor 60 is placed on the bottom wall 17 of the wringing chamber 11 to reduce the effective height of the wringing chamber 11 when the pressure bars 22, 24 are closed.

The adaptor 60 may have one or more openings as required for drainage. However provided that sufficient drainage is provided elsewhere by the wringing chamber, such openings in the adaptor 60 may not be required.

If desired the adaptor 60 and the wringing chamber 11 may be provided with formations so that the adaptor 60 positively locates in the wringing chamber 11, or the adaptor 60 could be a simple resilient wad which is simply placed in position.

In FIG. 5 it can be seen that at an exterior surface 61 of one end wall 16 there is provided a storage location for the adaptor 60 when the adaptor 60 is not in use. The exterior surface 61 has in this example one or more support formations 62 on which the adaptor 60 may be hung. A storage location for the adaptor 60 may otherwise and elsewhere be provided by the wringer device 10.

Various modifications are possible without departing from the scope of the present invention. For example the wringer device 10 need not be of the configuration illustrated. The actuating mechanism for moving the pressure bars 22, 24 need not be of the kind described with reference to the specific example. The configuration of the holder 40 is exemplary, and for other mop head 30 designs, and/or handle 45 designs, modifications may be made, provided that the connecting portion 48 is able to be received between the closed pressure bars 22, 24 of the wringer device 10, with the pressure bars 22, 24 bearing on a bearing surface or surfaces 50 of the mop head 30 to effect a wringing force on the mop material 33.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. In combination, a mop head and a wringer device, the mop head including a body and a holder, the mop head body supporting mop material, and the mop head holder in use, mounting the mop head to a handle, the mop head holder having a first part secured to or integral with the body, a second part which interengages, in use with the handle, to mount the handle to the mop head, and a connecting portion connecting the first and second holder parts, and wherein the wringer device includes a wringing chamber, a pair of pressure bars, and an actuating mechanism relatively to move the pressure bars between an open condition in which the pressure bars are apart and the mop head body is receivable between the pressure bars into the chamber, and a closed condition in which the pressure bars are alongside one another and are spaced from one another by a space, and the pressure bars act on a bearing surface or surfaces of the mop head to urge the mop head body towards a bottom of the wringing chamber to wring the mop material, and wherein when the pressure bars are in their closed condition acting on the bearing surface or surfaces of the mop head, the connecting portion of the holder extends along the space between the two pressure bars, the connecting portion having a thickness less than a minimum separation distance between the pair of pressure bars.

2. The combination according to claim 1 wherein the mop head body and the holder and the bearing surface or surfaces are provided as a single fabrication.

3. The combination according to claim 2 wherein the mop head body and the holder are fabricated in metal or moulded in a plastic material.

4. The combination according to claim 1 wherein the mop head body co-operates with a separate support member which together with the mop head body, supports the mop material.

5. The combination according to claim 1 wherein the holder co-operate with one or more other components to provide the mounting for the handle.

6. The combination according to claim 1 wherein the bearing surface or surfaces on which the pressure bars act, are one of integrally provided with the body, or attached to the body, or integral or attached to the holder.

7. The combination according to claim 1 wherein an adaptor is provided which is insertable into the wringing chamber to reduce the size of the wringing chamber.

8. The combination according to claim 7 wherein the adaptor is in the form of a plate-like member and is placed on the chamber bottom to reduce the effective depth of the wringing chamber.

9. The combination according to claim 7 wherein the wringer device provides a storage location for the adaptor when the adaptor is not in use.

10. The combination according to claim 9 wherein the wringer device provides a storage location for the adaptor when the adaptor is not in use on an exterior surface of the wringing chamber.

11. The combination according to claim 1 wherein the first part of the holder includes a socket to interengage with the handle, and the thickness of the connecting portion of the holder is less than the corresponding dimension of the socket.

12. The combination according to claim 1 wherein the connection portion has a length at least as long and preferably at least 1.5 times the length of the second holder part.

13. The combination according to claim 1 wherein the connecting portion is at least 15 mm long.

14. The combination according to claim 13 wherein the connecting portion is at least 25 mm long.

15. The combination according to claim 14 wherein the connecting portion is at least 35 mm long.

16. The combination according to claim 15 wherein the connecting portion at least 40 mm long.

* * * * *